US010647468B2

(12) United States Patent
Frost

(10) Patent No.: US 10,647,468 B2
(45) **Date of Patent: *May 12, 2020**

(54) BOX CONTAINER AND DISPLAY

(71) Applicant: VANGUARD PACKAGING, INC., Kansas City, MO (US)

(72) Inventor: Jerry Ryan Frost, Kansas City, MO (US)

(73) Assignee: Vanguard Packaging, LLC, Kansas City, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/596,381

(22) Filed: May 16, 2017

(65) Prior Publication Data

US 2017/0247136 A1 Aug. 31, 2017

Related U.S. Application Data

(63) Continuation of application No. 14/997,685, filed on Jan. 18, 2016, now Pat. No. 9,682,795, which is a (Continued)

(51) Int. Cl.
*B65D 5/50* (2006.01)
*B65D 5/44* (2006.01)

(Continued)

(52) U.S. Cl.
CPC ..... *B65D 5/5023* (2013.01); *B65D 5/324* (2013.01); *B65D 5/4266* (2013.01); *B65D 5/445* (2013.01); *B65D 5/505* (2013.01); *B31B 2105/00* (2017.08)

(58) Field of Classification Search
CPC ..... B65D 5/324; B65D 5/445; B65D 5/5023; B65D 5/505; B65D 5/4266; B31B 17/00; B31B 2201/295

(Continued)

(56) References Cited

U.S. PATENT DOCUMENTS 2,578,060 A 12/1951 Grant
2,918,178 A 12/1959 Leone (Continued)

FOREIGN PATENT DOCUMENTS

CA 2693596 A1 1/2009
DE 3924930 A1 2/1990
GB 1188834 A 4/1970

OTHER PUBLICATIONS

"Final office action received for U.S. Appl. No. 13/955,925 dated Jul. 15, 2015", 7 pages.

(Continued)

*Primary Examiner* — Christopher R Demeree
(74) *Attorney, Agent, or Firm* — Kutak Rock LLP

(57) ABSTRACT

A corrugated box container with a main component including a base section and first and second side sections. The box container additionally includes first and second side support components associated with the first and second side sections for reinforcing the first and second side support sections. The box container further includes a cover component that is capable of engagement with the main component or the first and second side support components, such that the main component and the cover component present a fully enclosed space within the box container. The box container is erected from a knockdown configuration by folding the first and second side sections until the side sections are generally perpendicular with the base section; connecting the first and second side support components with the first and second side sections respectively; and connecting the cover component with the main component or the first and second side support components.

19 Claims, 7 Drawing Sheets

Related U.S. Application Data continuation of application No. 13/955,925, filed on Jul. 31, 2013, now Pat. No. 9,238,523.

(60) Provisional application No. 61/677,979, filed on Jul. 31, 2012.

(51) Int. Cl.
*B65D 5/42* (2006.01)
*B65D 5/32* (2006.01)
*B31B 105/00* (2017.01)

(58) Field of Classification Search
USPC ..... 229/122.21, 122.24, 122.26, 122.32, 229/125.19, 125.27, 125.28, 164, 199, 229/167; 206/736, 774
See application file for complete search history.

(56) References Cited

U.S. PATENT DOCUMENTS 3,195,798 A 7/1965 Wilson
3,362,610 A 1/1968 Dyke
3,744,700 A * 7/1973 Stegmann ..... B65D 5/324 220/DIG. 25
3,987,737 A 10/1976 Smith
4,143,763 A 3/1979 Haglund
4,306,675 A 12/1981 Swanson
4,341,338 A 7/1982 Arnold
4,383,636 A 5/1983 Chaffers
4,427,108 A 1/1984 Coles et al.
4,458,838 A 7/1984 Lacasa et al.
4,506,790 A 3/1985 Muscari
4,567,996 A 2/1986 Muise
4,646,922 A 3/1987 Smith
4,709,852 A * 12/1987 Stoll ..... B65D 5/003 206/509
4,871,067 A 10/1989 Valenti
4,889,252 A 12/1989 Rockom et al.
4,911,355 A * 3/1990 Bannister ..... B65D 5/0045 229/143
4,932,533 A 6/1990 Collier
5,016,545 A 5/1991 Robertson et al.
5,145,244 A 9/1992 Kersting et al.
5,190,211 A 3/1993 Stoddard et al.
5,193,466 A 3/1993 Eder
5,213,220 A 5/1993 McBride
5,226,571 A 7/1993 Eastwood et al.
5,253,769 A 10/1993 Vlastakis
5,277,360 A 1/1994 Demott
5,301,800 A 4/1994 Kenney
5,312,034 A 5/1994 Nakagawa et al.
5,316,210 A 5/1994 Scullin
D348,000 S 6/1994 Strasevicz et al.
5,318,789 A 6/1994 Nakagawa et al.
5,322,212 A 6/1994 Strasevicz et al.
5,333,777 A 8/1994 Roth
D352,235 S 11/1994 Strasevicz et al.
5,579,991 A 12/1996 Strasevicz et al.
5,702,011 A 12/1997 Carroll
5,706,959 A 1/1998 Smith
5,826,732 A 10/1998 Ragsdale
5,966,857 A 10/1999 Pettersson et al.
6,068,140 A 5/2000 Mangrum et al.
6,126,254 A 10/2000 Maglione
6,168,073 B1 1/2001 Towle
6,347,772 B1 2/2002 L'Hotel
6,378,710 B1 4/2002 Grueneberg
6,508,023 B2 1/2003 Moss et al.
6,612,669 B2 9/2003 Grueneberg
6,715,623 B2 4/2004 Broerman
7,007,615 B2 3/2006 Grueneberg
7,066,342 B2 6/2006 Baechle et al.
7,111,735 B2 9/2006 Lowry
7,137,517 B2 11/2006 Lowry et al.
7,252,200 B1 8/2007 Hester
7,281,648 B2 10/2007 Lowry
7,546,927 B2 6/2009 Lowry et al.
7,634,865 B2 12/2009 L'Hôtel
7,677,433 B2 3/2010 Little
7,703,864 B2 4/2010 Moser
7,810,707 B2 10/2010 Little
7,819,305 B2 10/2010 Little
7,861,916 B2 1/2011 Little
7,981,017 B2 7/2011 Little
8,281,981 B2 * 10/2012 Foden ..... B65D 5/5445 206/746
8,596,518 B2 12/2013 Babcock
8,740,054 B2 * 6/2014 Pinkstone ..... B65D 5/0015 206/736
9,238,523 B1 1/2016 Frost
9,682,795 B1 6/2017 Frost
2002/0108541 A1 8/2002 Grueneberg
2003/0160015 A1 8/2003 Broerman
2005/0067321 A1 3/2005 Pitts et al.
2008/0030113 A1 2/2008 Vail
2008/0083682 A1 4/2008 Moss et al.
2008/0169340 A1 7/2008 Sheffer
2009/0286663 A1 11/2009 Little et al.
2010/0083618 A1 4/2010 Little
2010/0087304 A1 4/2010 Little
2010/0234201 A1 9/2010 Little et al.
2010/0236117 A1 9/2010 Mestres et al.
2011/0011922 A1 1/2011 Little
2012/0012734 A1 1/2012 Tzuo
2013/0026060 A1 * 1/2013 Moss ..... B65D 5/0035 206/512
2013/0213915 A1 8/2013 Pfeifer et al.

OTHER PUBLICATIONS

"Non-Final office action received for U.S. Appl. No. 13/955,925 dated Oct. 7, 2014", 6 pages.
"Notice of Allowance received for U.S. Appl. No. 14/997,685 dated Feb. 17, 2017", 5 pages.
"Notice of Allowance received for U.S. Appl. No. 13/955,925 dated Sep. 11, 2015", 7 pages.

* cited by examiner

BOX CONTAINER AND DISPLAY

RELATED APPLICATIONS

The present patent application is a continuation application of co-pending U.S. patent application Ser. No. 14/997,685, filed Jan. 18, 2016, which is a continuation application of U.S. patent application Ser. No. 13/955,925, filed Jul. 31, 2013, now U.S. Pat. No. 9,238,523, which claims priority benefit, with regard to all common subject matter, of earlier-filed U.S. Provisional Patent Application No. 61/677,979, filed Jul. 31, 2012, and entitled "IMPROVED STACKABLE TRAY." The identified earlier-filed patent applications are hereby incorporated herein by reference in their entireties.

FIELD

Embodiments of the present invention relate generally to the field of point of purchase merchandise shipping and display containers. More particularly, embodiments of the present invention relate to a corrugated, paperboard container and display that is manufactured in a fold and glue assembly process and that is traditionally provided to an end user in a collapsed or knockdown configuration for setup.

BACKGROUND

Corrugated containers are made from pieces of flat paperboard stock material that are die cut into shapes that define various panels. The shapes are folded along predefined lines between the panels with at least one overlapping strip or panel that is glued, taped or otherwise affixed to another panel to form an enclosed boundary. The panels are folded and/or glued into place to become the walls of the container. The containers are traditionally provided to product manufacturers and/or retailers in a collapsed or knock-down configuration for storage, handling and shipping. The manufacturer and/or retailers open the knockdown containers and fold appropriately to utilize the assembled container for packing and/or displaying products therein.

The knockdown containers are typically manufactured by feeding flat die cut sheets through a fold-and-glue machine. The fold-and-glue machine applies adhesive and folds over select panels so that the panels are in the knock-down configuration. One common knock-down container is an open-top style box container. An open-top style box container is typically used to ship products to retailers, who can then display the products to consumers at the retailer's point-of-sale location. It is desirable to minimize the time and effort necessary for retailers to assemble a container from its knock-down configuration. Thus, such container suppliers typically attempt to design containers that do not require separate discrete parts such as reinforcing inserts or dividers. However, in circumstances in which heavy products are being displayed in the containers, it is often necessary to utilize separate metal supports and/or corrugated support dividers to handle the heavy load. This adds considerably to the assembly labor as well as material costs for the container. Furthermore, other circumstances may require the containers to transport and secure fragile items. Standard open-top style box containers are generally not appropriate for handling such fragile items because the open-top does not provide the security required for the fragile items.

An example of such an open-top style box container is shown and described in U.S. Pat. No. 7,981,017 (the '017 patent"), the entire disclosure of which is incorporated herein by reference. However, the container disclosed in the '017 patent is not configured to handle heavy loads or to maintain fragile items therein. Therefore, it would be beneficial to provide a box container that can accommodate heavier product loads without requiring additional support members and that can support fragile items safely during transport and display.

SUMMARY

Embodiments of the present invention include a corrugated box container with a main component including a base section and first and second side sections. The box container additionally includes first and second side support components associated with the first and second side sections for reinforcing the first and second side support sections. The box container further includes a cover component that can be engaged with the main component or the first and second side support components, such that the main component and the cover component present a fully enclosed space within the box container.

Embodiments of the present invention additionally include a method for making a corrugated box container, with the method including the initial step of forming a main component that includes a base section opposed on sides by a first side section and a second side section. The next step includes forming fold lines between the first side section and the base section and between the second side section and the base section. The method additionally includes the step of forming side support components that can be associated with each of the first and second side sections of the main component to reinforce the side sections. The method includes the final step of forming a cover component operable to be engaged with the main component or the first and second side support components so as to fully enclose a space within the box container.

Embodiments of the present invention additionally include a method of erecting a corrugated box container, with the method including providing the box container in a knockdown configuration, with the box container having a main component comprising a base section opposed by first and second side sections, first and second side support components, and a cover component. The method includes folding the first and second side sections until the side sections are generally perpendicular with the base section. The method includes the next step of connecting the first and second side support components with the first and second side sections respectively, such that the support components are operable to reinforce the side sections. Finally, the method includes the step of connecting the cover component with the main component or the first and second side support components so as to provide a fully enclosed space within the box container.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
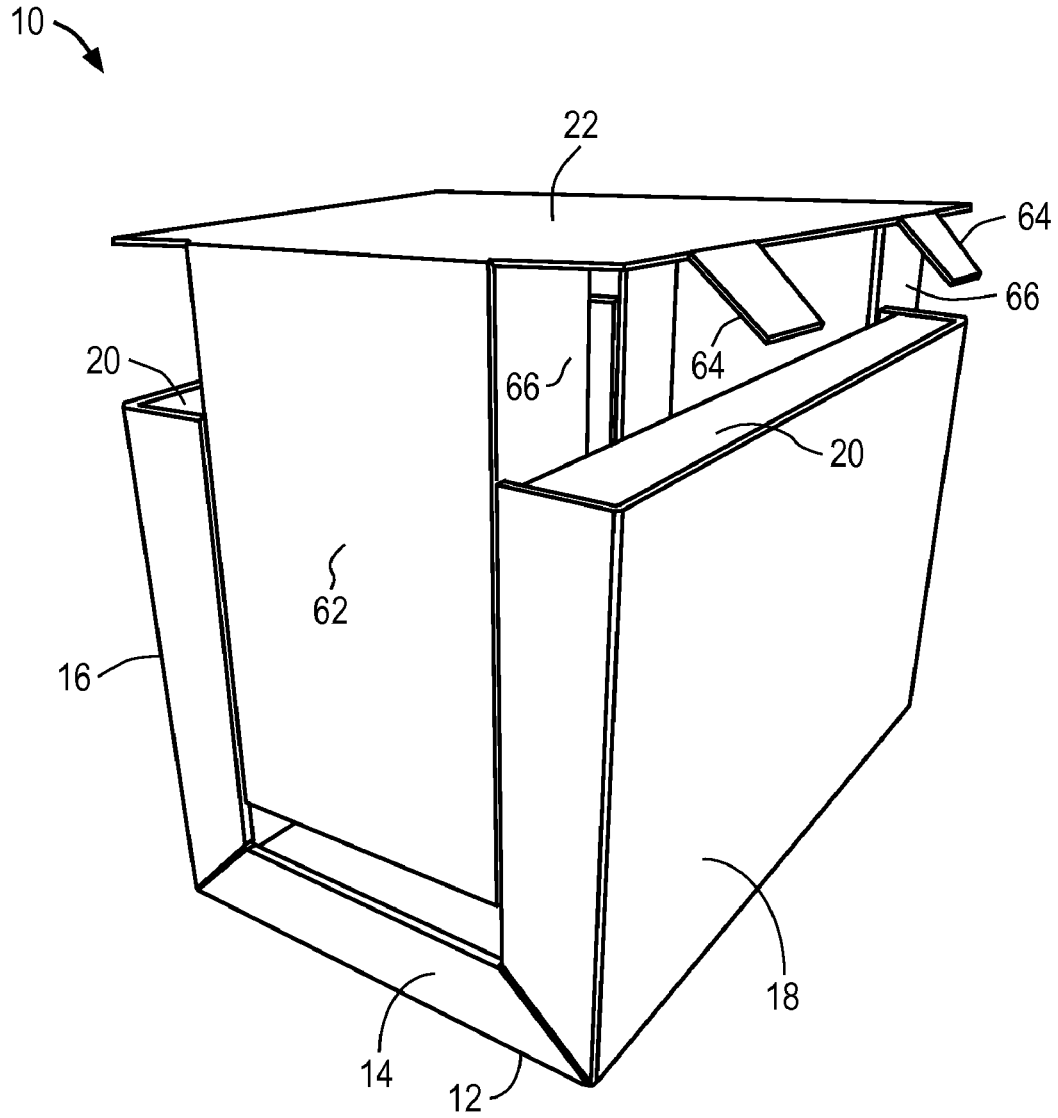
FIG. 1 is a perspective view of the box container according to embodiments of the present invention, with the box container including a main component, two side support components, and a cover component.
Figure 2:
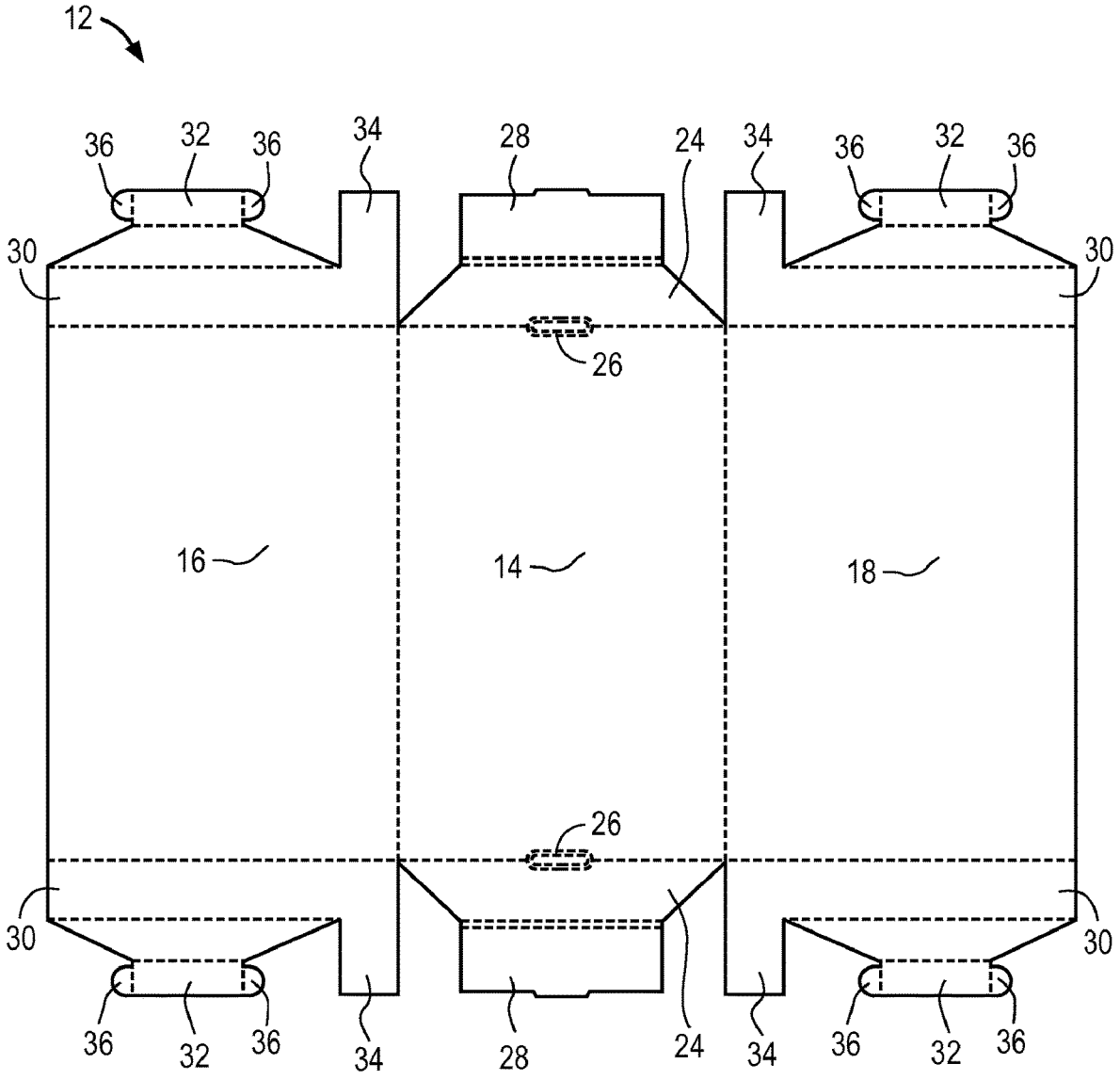
FIG. 2 is a perspective view of the main component from FIG. 1 in a knockdown configuration.
Figure 3:
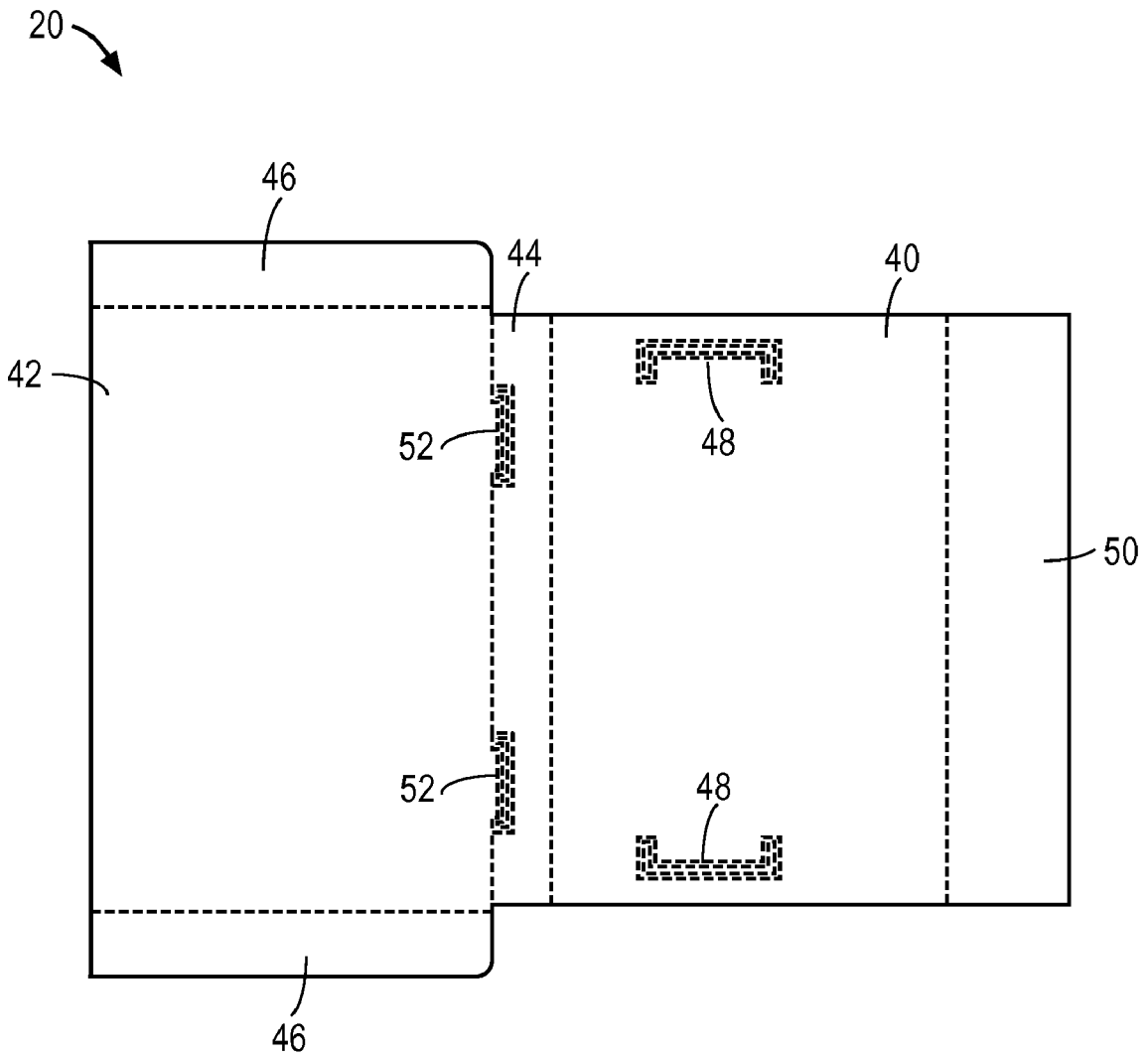
FIG. 3 is a perspective view of one of the side support components from FIG. 1 in a knockdown configuration.
Figure 4:
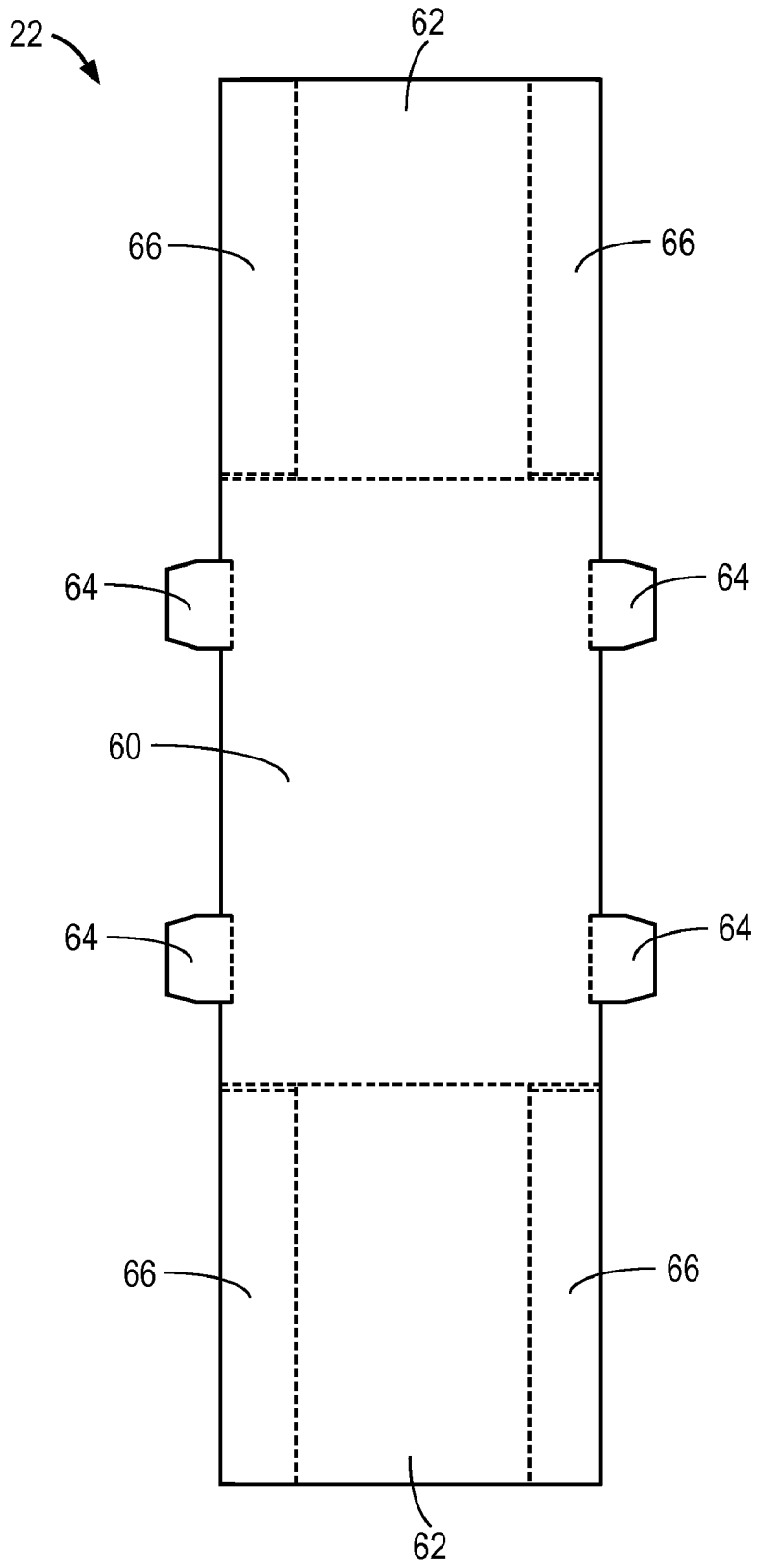
FIG. 4 is a perspective view of the cover component from FIG. 1 in a knockdown configuration.
Figure 5:
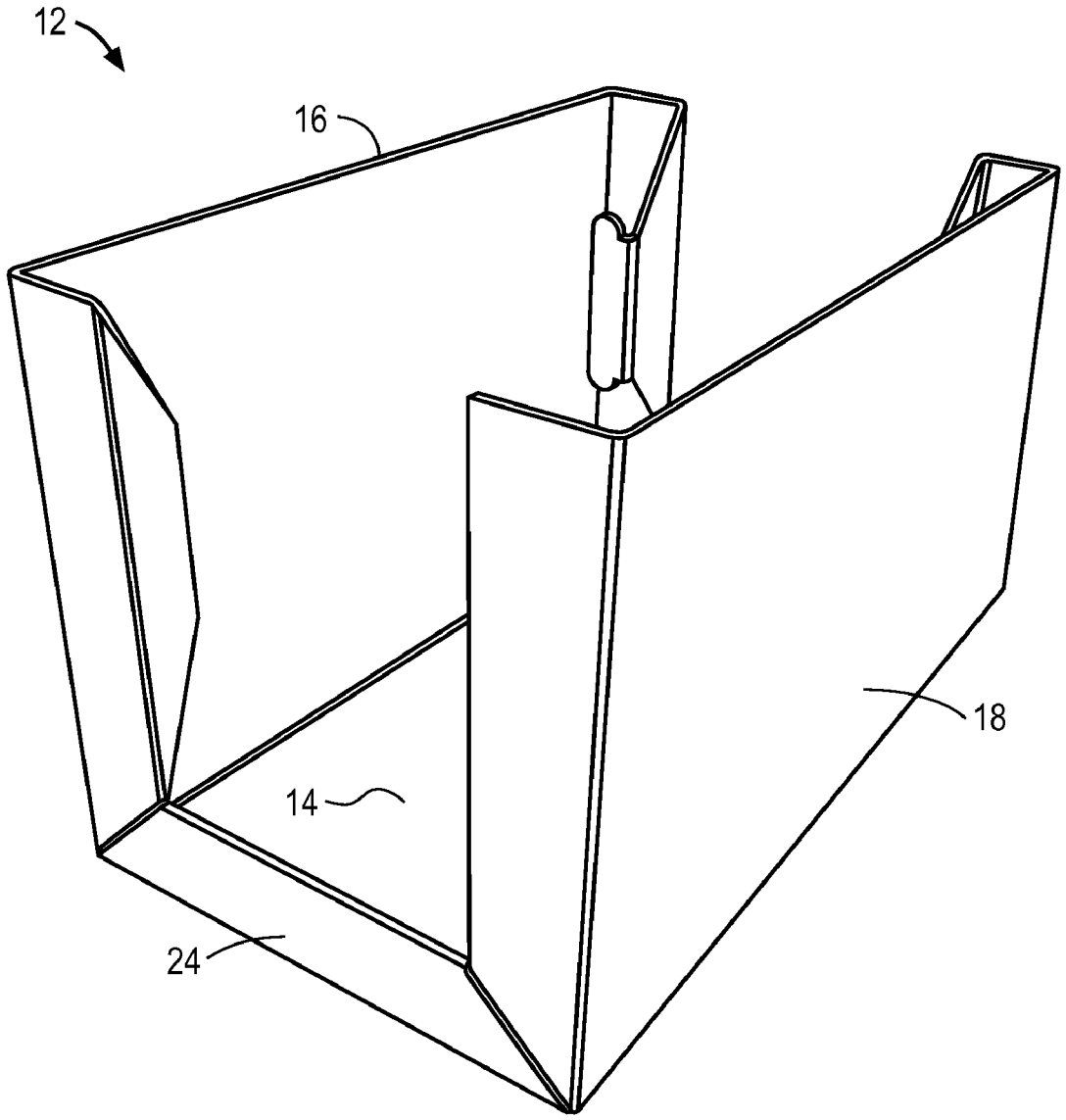
FIG. 5 is a perspective view of the main component from FIGS. 1 and 2 in an erected configuration.
Figure 6:
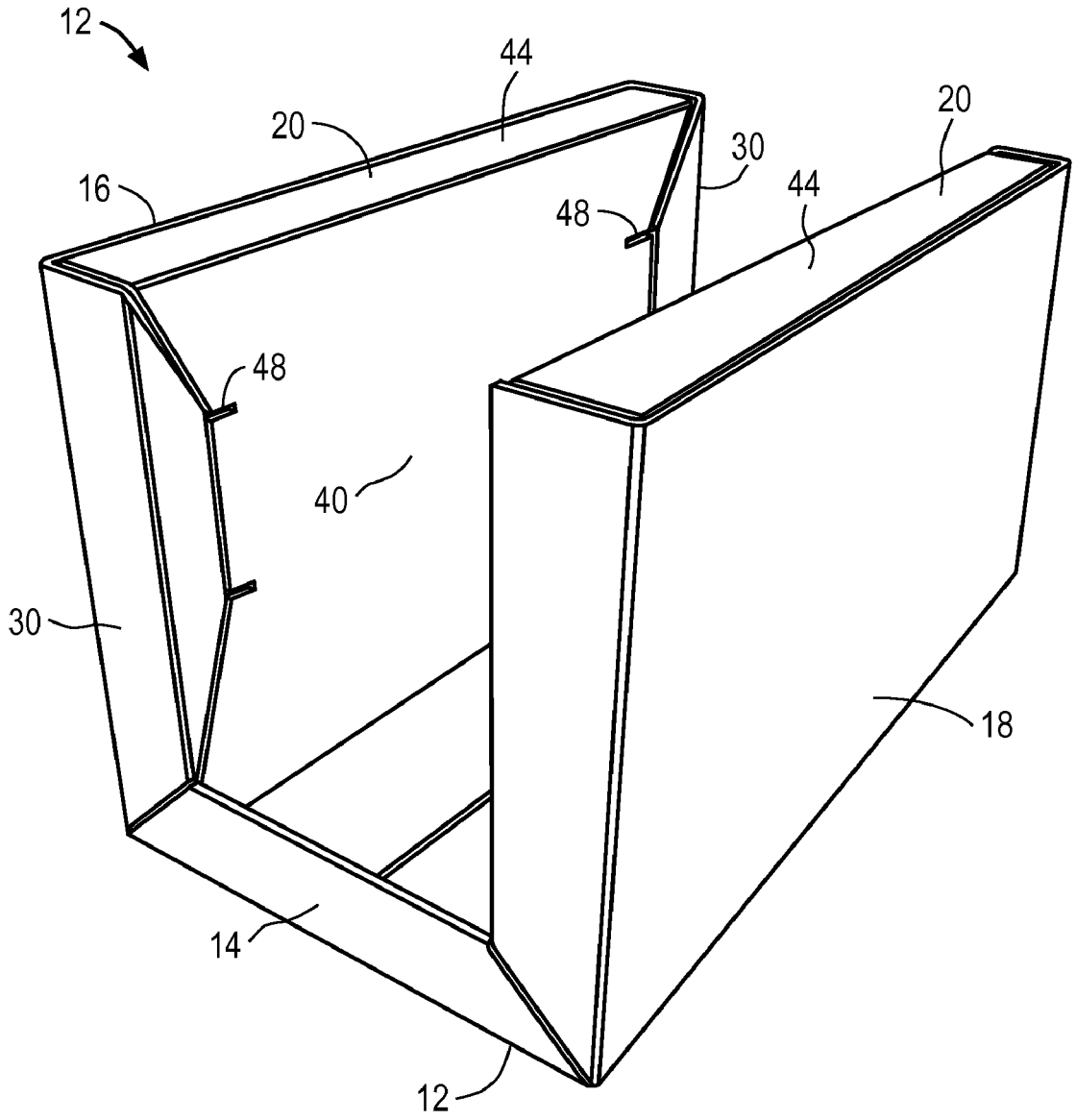
Figure 7:
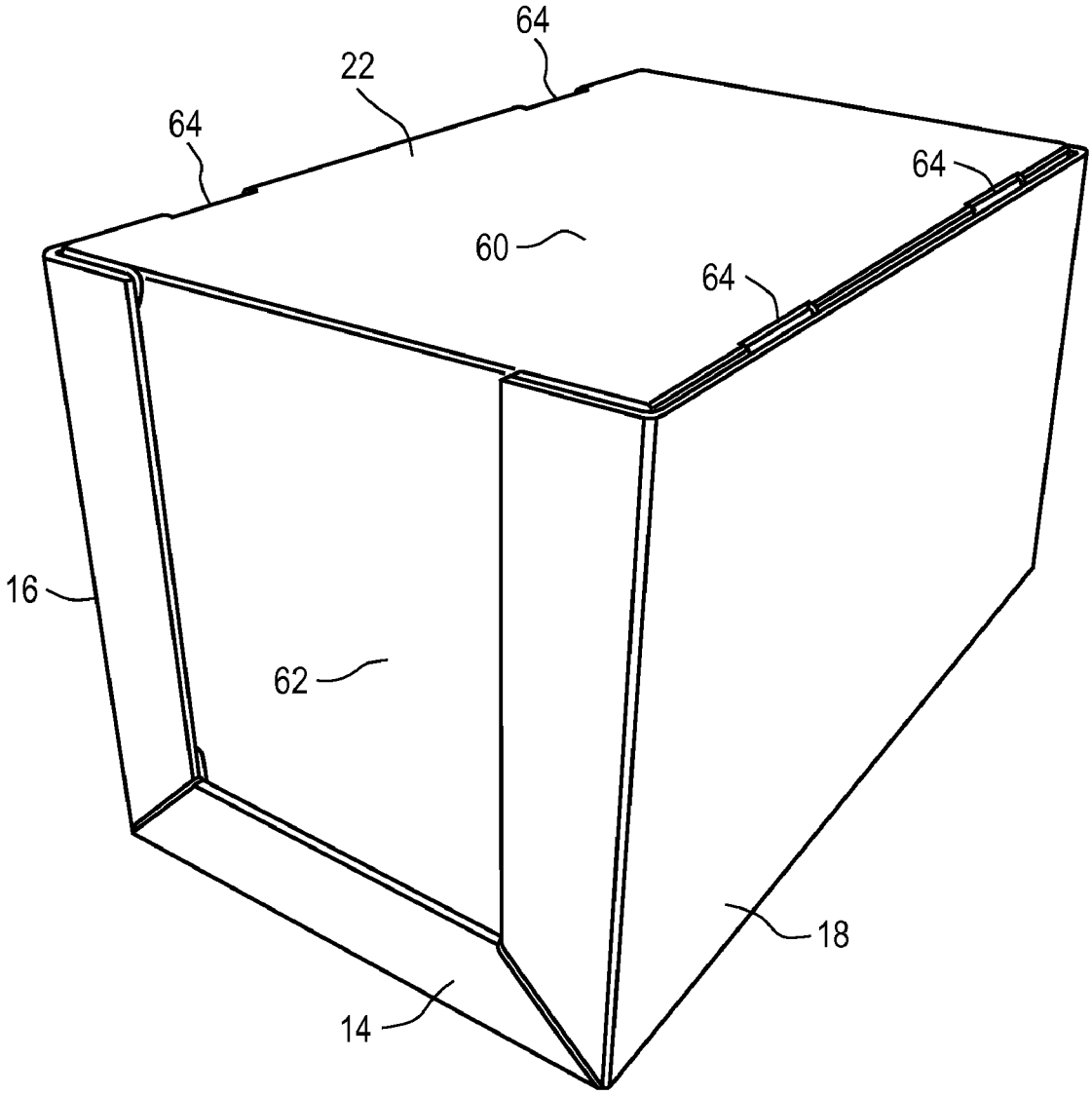

FIG. 6 is a perspective view of the main component from FIGS. 1, 2, and 5 with two side support components from FIGS. 1, and 3 secured thereto, each in an erected configuration; and FIG. 7 is a perspective view of the main component from FIGS. 1, 2, 5 and 6 with the two side support components from FIGS. 1, 3, and 6 secured thereto, and further including the cover component from FIGS. 1 and 4 secured thereto, all in an erected configuration.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

As shown in FIG. 1, embodiments of the present invention include a box container 10 that includes a main component 12 having a base section 14 opposed by a first side section 16 and a second side section 18; side support components 20 operable engage with the first side section and the second side section of the main component; and a cover component 22 operable engage with portions of the first and second side support sections and to act as a cover for the box container. In some embodiments, the box container 10 is initially be produced in a knockdown configuration (i.e., a generally flat, two-dimensional form), such as illustrated in FIGS. 2-4. From the knockdown configuration, the box container 10 is transformed into the erected configuration shown in FIG. 1. When in the erected configuration, the box container 10 is operable to securely hold heavy and/or fragile items, and to support such items through transportation and/or shipping. In some embodiments, the box container 10 is formed from one or more sections of corrugated material. In some embodiments, such corrugated material includes paperboard. However, other embodiments provide for the corrugated material to include other similar type materials, such as cardboard, fiberboard, or the like.

Turning to FIG. 2, and as described above, the main component 12 of the box container 10 of embodiments of the present invention has three primary sections, including the base section 14 opposed by first and second side sections 16,18. The main component 12 has thereon fold lines along which in some embodiments can be weakened, or in other embodiments, caused preferentially to fold by any of various means. For example, in some embodiments the corrugated material is compressed along a thin line defining a fold line. In other embodiments the corrugated material is cut part way through along the line, or cut all or part way through the line at spaced intervals. Thus, each of the first and second side sections 16,18 in some embodiments are separated from the base section by fold lines. As such, each of the first and second side sections 16,18 in some embodiments are operable to rotate or fold with respect to the base section 14. For illustrative purposes, the fold lines of the box container 10 are illustrated by single dotted lines in the attached drawings, and are particularly illustrated in FIGS. 2-4.

Remaining with FIG. 2, the base section 14 of the main component 12 generally includes a rectangular or square-shaped central section and two lip sections 24 connected with the rectangular or square-shaped section via fold lines. As such, each of the lip sections 24 in some embodiments is operable to be rotate or fold with respect to the central section. In some embodiments, such fold lines each additionally include one or more slits 26, cutouts, and/or slots extending down a portion thereof. The lip sections 24 in some embodiments include one or more tabs 28. Remaining with FIG. 2, the base section 14 further includes the first and second side sections 16,18, which each include two end portions 30 connected with the side sections via fold lines. As such, each of the end portions 30 in some embodiments are operable to rotate or fold with respect to the side sections 16,18 to which they are attached. The end portions 30 in some embodiments each include main tabs 32 and side tabs 34 that function to secure the box container 10 in an erected position, as will be discussed in more detail below. The tabs 32 in some embodiments include tab fingers 36 that extend from sides of the tabs and that operate to secure the tabs 32 within a corresponding opening (e.g., a cutout), as will be discussed in more detail below.

Turning to FIG. 3, the side support components 20 each include an inner panel 40 and an outer panel 42, with the inner and outer panels separated by a central panel 44 via fold lines. As such, each of the inner and outer panels 40,42 in some embodiments are operable rotate or fold with respect to the central panel 44. In certain embodiments, the inner and outer panels 40,42 have shapes and sizes that generally correspond to the shape and size of the side sections 16,18 of the main component 12. In certain embodiments, the outer panel 42 includes two flange sections 46 that are each operable to fold along fold lines. The inner panel 40 includes two openings 48 in the form of slits or notch-shaped cutouts. In certain embodiments, the inner panel 40 includes a single flange section 50 that extends from a side of a main portion of the inner panel opposite the central panel 44. Further, the central panel 44 includes two openings 52 in the form of slits or notch-shaped cutouts. As will be discussed in more detail below, the openings 48 of the inner panel 40 are used in some embodiments for mating with tabs 32 of the main component 12, and the openings 52 of the central panel 44 are used with portions of the cover component 22 so as to secure the box container 10 in an erected configuration.

With reference to FIG. 4, in certain embodiments, the cover component 22 of the box container 10 includes a top section 60 and end sections 62, with the end sections separated from the top section by fold lines. As such, each of the end sections 62 is operable to rotate or fold with respect to the top section 60. In certain embodiments, the top section 60 has a size and a shape that corresponds to the size and shape of the central section of the base section 14 of the main component 12. The top section 60 in some embodiments has four main tabs 64, with two tabs being positioned on each side of the top section. The end sections 62 in some embodiments each include two flange sections 66 positioned on sides of the end sections and separated from main portions of the end sections via fold lines. As such, each of flange sections 66 are operable to rotate or fold with respect to the main portions of the end sections 60. The four main tabs 64 and the flange sections 66 are operable to secure the box container 10 in an erected position, as will be discussed in more detail below.

In operation of embodiments of the present invention, the box container 10 is transformed in a quick and efficient manner from the knockdown configuration of FIGS. 2-4 to the erected configuration of FIG. 1. To begin, and with reference to FIG. 5, the first and second side sections 16,18 of the main component 12 are folded in along their fold lines until the side section are generally parallel with each other and are generally perpendicular with the base section 14. Next, the lip sections 24 are folded about the fold lines connecting the lip sections with the central section of the base section 14 until the lip sections are orientated generally perpendicularly with the central section. As such, the tabs 28 (not shown in FIG. 5) are capable of being inserted within the slits 26 (not shown in FIG. 5) to secure the lip sections 24 in place. In addition, the side tabs 34 (not shown in FIG. 5) of the end portions 30 (not shown in FIG. 5) of the side sections 16,18 are capable of being inserted between a portion of the lip sections 24 that were folded together, such that the side sections are secured in position that is generally perpendicular to the base section 14. In certain embodiments, the first and second side sections 16,18 are secured via frictional forces imparted between the lip sections 24 and the side tabs 34. In other embodiments, the side tabs 34 are secured to the lip sections 24 via an adhesive, such as glue, tape, or the like. As such, the main component 12 is erected to present a box-shaped container that includes a base and two side sections.

With reference to FIG. 6, in the embodiment shown, the two side support components 20 are secured to the main component 12 to reinforce each of the first and second side sections 16,18. In more detail, the inner and outer panels 40,42 (outer panel not shown in FIG. 6) of each of the side support components 20 are folded about the central panel 44 until the inner and outer panels are generally parallel with each other and perpendicular to the central panel. As such, the outer panel 40 of a first side support component 20 in the embodiment shown is positioned adjacent to an interior-facing surface of the first side section 16 of the main component 12. Similarly, in the embodiment shown, the outer panel 40 of a second side support component 20 is positioned adjacent to an interior-facing surface of the second side section 18 of the main component 12. Next, in the embodiments shown, the end portions 30 of the first and second side sections 16,18 are wrapped around the side support components 20, and each the main tabs 32 (not shown in FIG. 6) of the end portions are mated within the openings 48 of the inner panels 40 of the side support components. In certain embodiments, before the main tabs 32 are inserted within the openings 48, the tab fingers 36 (not shown in FIG. 6) are folded against the remaining portions of the main tabs 32. Once the main tabs 32 have been inserted, the tab fingers 36 are capable of unfolding, thus securing the main tabs within the openings 48. As such, the side support components 20 are secured in place to the main component 12 and are operable to reinforce the side sections 16,18 of the main component.

Finally, with reference to FIGS. 1 and 7, in the embodiment shown, the cover component 22 is arranged into position by folding the end sections 62 about the fold lines until the end sections are generally parallel with respect to each other and perpendicular to the top section 60. Next, the flange sections 66 (not shown in FIG. 7) of the end sections are folded about their fold lines until they are generally perpendicular to their respective end section 62. As such, the cover component 22 is capable of being secured to the remaining components of the box container 10, so as to provide a top cover and end covers for securely enclosing a space within the box container. In particular, the end sections 62 are capable of being positioned between the first and second side sections 16,18, such that the flange sections 66 of the end sections are adjacent to the inner panels 40 of the side support components 20 (not shown in FIG. 7). As such, the flange sections 66 are operable to provide frictional support to secure the cover component 22 in place. Further, the four main tabs 64 of the cover component 22 are mated with the openings 52 (not shown in FIGS. 1 and 7) on the central section 44 of each of the side support components 20. Such mating further provides for the cover component 22 to be secured in place, such as illustrated by FIG. 7.

With the box container 10 in an erected configuration as described above, the box container is operable to provide a reinforced, enclosed container that is capable of securely holding fragile items during shipping or transportation. Because the box container 10 includes the side support components 20 and the cover component 22, the box container is reinforced to protect the container, and the items stored therein, from external forces. Furthermore, the side support components 20 and cover component 22 are operable to provide an enclosed area within the box container 10, such that items included within the box container are protected from the elements during shipping or other transportation. Furthermore, because the box container 10 is reinforced and has all sides covered, multiple box containers can be stacked on top of each other to facilitated efficient use of space. Furthermore, once the box container 10 has reached its intended destination, the cover component 22 is removed from the remaining components of the box container, and the remaining components are used to display the items that were enclosed therein. Thus, embodiments of the present invention provide for the box container 10 to be used to securely transport items, and further to display such items after transport.

Although the invention has been described with reference to the embodiments illustrated in the attached drawing figures, it is noted that equivalents may be employed and substitutions made herein without departing from the scope of the invention as recited in the claims.

What is claimed is:

1. A corrugated box container that is moveable between a shipping configuration and a display configuration, the container comprising:

a main component defining a generally open top and a generally open front so as to accommodate displaying items within an interior area of said main component when the container is in the display configuration; and a cover component comprising a top section and a front end section extending generally perpendicularly from said top section, wherein said cover component is configured to selectively engage with said main component, thereby at least partially concealing the items within said interior area of said main component, wherein said front opening of said main component is configured to selectively receive said front end section of said cover component when said cover component is engaged with said main component, wherein said front end section comprises a front panel and opposed flange sections extending generally perpendicularly from opposed sides of said front panel:

wherein said main component further defines a generally open back so as to further accommodate displaying items within the interior area of the main component when the main component is in the display configuration, wherein said cover component further comprises a rear end section extending generally perpendicularly from said top section, wherein said rear end section comprises a rear panel and opposed flange sections extending generally perpendicularly from opposed sides of said rear panel, and wherein said main component comprises:

a base section extending between opposed first and second side sections; and first and second side support components associated with respective first and second side sections, each of said first and second side support components comprising an inner panel and a central panel extending from respective inner panels towards respective first and second side sections.

2. The corrugated box container of claim 1, wherein a flat surface of each said flange section of said front end section of said cover component comprises opposed top and bottom edges and a flat surface extending therebetween, the corrugated box container being configured such that at least a top portion of each said flat surface rests against a corresponding flat surface of said main component when said cover component is engaged with said main component, thereby inhibiting the cover component from becoming disengaged from the main component through friction between the respective flat surfaces.

3. The corrugated box container of claim 1, wherein a flat surface of each of said flange sections of said rear end section of said cover component rests against a flat surface of said main component when said cover component is engaged with said main component, thereby inhibiting the cover component from becoming disengaged from the main component through friction between the respective flat surfaces.

4. The corrugated box container of claim 3, wherein said rear end section is displaced from said front end section and wherein said flange sections of said front end section extend towards said rear end section.

5. The corrugated box container of claim 4, wherein said flange sections of said rear end section extend towards said front end section.

6. The corrugated box container of claim 1, wherein:

said base section and said first and second side sections are formed from a first piece of material, said first and second side support components are formed from respective second and third pieces of material, an internal structure of said side sections of said main component are configured in a first direction, and an internal structure of said side support components are configured in a second direction substantially perpendicular to the first direction.

7. The corrugated box container of claim 6, wherein the first direction is substantially vertical and the second direction is substantially lateral.

8. The corrugated box container of claim 1, wherein said main component comprises a base section extending between opposed first and second side sections, said first and second side sections extending generally perpendicularly from said base section when the container is in the display configuration.

9. A method of making a corrugated box container, the method comprising:

forming a main component, said main component defining a generally open top and a generally open front so as to accommodate displaying items within an interior area of said main component when the main component is in a display configuration;

cutting a periphery of a cover component; and forming said cover component, said cover component having a top section and a front end section extending generally perpendicularly from said top section, wherein said cover component is configured to selectively engage with said main component, thereby at least partially concealing the items within said interior area of said main component, wherein said front opening of said main component is configured to selectively receive said front end section of said cover component when said cover component is engaged with said main component, and wherein said front end section comprises a front panel and opposed first and second flange sections extending generally perpendicularly from opposed first and second sides of said front panel, wherein said main component further defines a generally open back so as to further accommodate displaying items within the interior area of the main component when the main component is in the display configuration, and wherein said cover component further comprises a rear end section extending generally perpendicularly from said top section, wherein said rear end section comprises a rear panel and opposed flange sections extending generally perpendicularly from opposed sides of said rear panel; and wherein said main component comprises:

a base section extending between opposed first and second side sections; and first and second side support components associated with respective first and second side sections, each of said first and second side support components comprising an inner panel and a central panel extending from respective inner panels towards respective first and second side sections.

10. The method of claim 9, wherein forming said cover component comprises:

forming a fold line between said top panel and said front panel, thereby forming at least part of a front edge of said top panel and at least part of a top edge of said front panel; and folding said front panel until it is generally perpendicular to said top section.

11. The method of claim 9, wherein cutting the periphery of said cover component comprises:

cutting at least part of a front edge of said top panel with a first cut; and cutting a top edge of said first flange section with a second cut, wherein the first cut is displaced from the second cut such that said top edge of said first flange section is displaced from said front edge of said top panel when said cover component is in a flat configuration.

12. The method of claim 11, wherein the distance between the first and second cuts is generally equal to a thickness of the top panel, and wherein forming said cover component further comprises:

forming fold lines between said front panel and said first and second flange sections; and folding said first and second flange sections until they are generally perpendicular to said front panel.

13. The method of claim 9, wherein:

cutting the periphery of said cover component comprises:

cutting a top edge of said first flange section with a first cut, cutting at least part of a front edge of said top panel with a second cut;

cutting a top edge of said third flange section with a third cut, and cutting at least part of a rear edge of said top panel with a fourth cut; and forming said cover component further comprises:

forming front and rear fold lines between said top panel and respective front and rear panels;

folding said front and rear panels until they are generally perpendicular to said top section, each of the front and rear panels extending generally downward from said top panel;

forming first and second fold lines between said front panel and respective first and second flange sections;

forming third and fourth fold lines between said rear panel and respective third and fourth flange sections; and folding said first, second, third, and fourth flange sections until they are generally perpendicular to respective front and rear panels.

14. A method of utilizing a cover component of a corrugated box container to at least partially conceal items within an interior area of a main component of the corrugated box container, the method comprising:

providing said main component in a knockdown configuration;

folding said main component from its knockdown configuration to an erected configuration defining a generally open top and a generally open front so as to accommodate displaying items within the interior area of said main component when the main component is in a display configuration;

providing said cover component in a knockdown configuration;

folding said cover component from its knockdown configuration to an erected configuration comprising a top section and a front end section extending generally perpendicularly from said top section;

positioning items within said interior area of said main component; and engaging said cover component with said main component so as to enclose the items within said interior area, thereby at least partially concealing the items, wherein said front opening of said main component is configured to selectively receive said front end section of said cover component when said cover component is engaged with said main component, and wherein said front end section comprises a front panel and opposed first and second flange sections extending generally perpendicularly from opposed first and second sides of said front panel, wherein said main component further defines a generally open back so as to further accommodate displaying items within the interior area of the main component when the main component is in a display configuration, and wherein said cover component further comprises a rear end section extending generally perpendicularly from said top section, wherein said rear end section comprises a rear panel and opposed flange sections extending generally perpendicularly from opposed sides of rear panel.

15. The method of claim 14, wherein engaging said cover component with said main component comprises engaging a flat surface of each of said flange sections of said front end section of said cover component with a corresponding flat section of said main component, thereby inhibiting the cover component from becoming disengaged from the main component through friction between the respective flat surfaces, and wherein said generally open back is configured to selectively receive said rear end section of said cover component when said cover component is engaged with said main component.

16. A corrugated box container that is moveable between a shipping configuration and a display configuration, the container comprising:

a main component defining a generally open top and a generally open front so as to accommodate displaying items within an interior area of said main component when the container is in the display configuration; and a cover component comprising a top section and a front end section extending generally perpendicularly from said top section, wherein said cover component is configured to selectively engage with said main component, thereby at least partially concealing the items within said interior area of said main component, wherein said front opening of said main component is configured to selectively receive said front end section of said cover component when said cover component is engaged with said main component, wherein said front end section comprises a front panel and opposed flange sections extending generally perpendicularly from opposed sides of said front panel:

wherein said main component further defines a generally open back so as to further accommodate displaying items within the interior area of the main component when the main component is in the display configuration, wherein said cover component further comprises a rear end section extending generally perpendicularly from said top section, wherein said rear end section comprises a rear panel and opposed flange sections extending generally perpendicularly from opposed sides of said rear panel, and wherein said front panel of said front end section remains generally parallel with said rear panel of said rear end section as the container is moved between the shipping configuration and the display configuration.

17. The corrugated box container of claim 16, wherein said main component comprises a base section extending between opposed first and second side sections, wherein said first side section remains generally parallel with said second side section as the container is moved between the shipping configuration and the display configuration.

18. A corrugated box container that is moveable between a shipping configuration and a display configuration, the container comprising:

a main component defining a generally open top and a generally open front so as to accommodate displaying items within an interior area of said main component when the container is in the display configuration; and a cover component comprising a top section and a front end section extending generally perpendicularly from said top section, wherein said cover component is configured to selectively engage with said main component, thereby at least partially concealing the items within said interior area of said main component, wherein said front opening of said main component is configured to selectively receive said front end section of said cover component when said cover component is engaged with said main component, wherein said front end section comprises a front panel and opposed flange sections extending generally perpendicularly from opposed sides of said front panel:

wherein said main component further defines a generally open back so as to further accommodate displaying items within the interior area of the main component when the main component is in the display configuration, wherein said cover component further comprises a rear end section extending generally perpendicularly from said top section, wherein said rear end section comprises a rear panel and opposed flange sections extending generally perpendicularly from opposed sides of said rear panel, and wherein said cover component is configured to slide vertically relative to said main component as the container is moved between the shipping configuration and the display configuration.

19. The corrugated box container of claim 18, wherein said main component comprises a base section extending between opposed first and second side sections, wherein said first side section remains generally parallel with said second side section as the container is moved between the shipping configuration and the display configuration.

* * * * *